US005435534A

United States Patent [19]

Linkowski et al.

[11] Patent Number: 5,435,534

[45] Date of Patent: Jul. 25, 1995

[54] METHOD FOR ACCUMULATING, FOLDING AND SUBSETTING COLLATION

[75] Inventors: William J. Linkowski, Danbury; Richard F. Stengl, Wolcott, both of Conn.

[73] Assignee: Pitney Bowes Inc., Stamford, Conn.

[21] Appl. No.: 272,482

[22] Filed: Jul. 11, 1994

[51] Int. Cl.[6] ..... B42C 1/00; B65H 37/06

[52] U.S. Cl. ..... 270/51; 270/54

[58] Field of Search ..... 270/45, 46, 51, 54, 270/55, 37

[56] References Cited

U.S. PATENT DOCUMENTS

| | | | |
|---|---|---|---|
| 1,326,859 | 12/1919 | Grammer | 270/45 |
| 3,441,267 | 4/1969 | Carstens | 270/45 |
| 4,079,928 | 3/1978 | Weschenfelder et al. | 270/55 |
| 4,898,570 | 2/1990 | Luperti et al. | 270/45 X |
| 4,921,235 | 5/1990 | Biagiotti et al. | 270/45 X |
| 5,377,965 | 1/1995 | Mandel et al. | 270/54 X |

*Primary Examiner*—John E. Ryznic

*Attorney, Agent, or Firm*—Charles R. Malandra, Jr.; Melvin J. Scolnick

[57] ABSTRACT

A method of folding and accumulating a plurality of paper sheets. The method comprises: feeding a plurality of paper sheets seriatim into a first accumulator to form a first sub-set of paper sheets; feeding a plurality of paper sheets sedatim into a second accumulator to form a second sub-set of paper sheets; feeding the second sub-set of sheets through a folding device to form a folded second sub-set of sheets; depositing the folded second sub-set of sheets onto an accumulating deck; feeding the first sub-set of sheets through the folding device to form a folded first sub-set of sheets; and depositing the folded first subset of sheets on top of the second sub-set of sheets on the accumulating deck, to thereby form a final, folded collation consisting of the two folded sub-sets.

8 Claims, 3 Drawing Sheets

METHOD FOR ACCUMULATING, FOLDING AND SUBSETTING COLLATION

BACKGROUND OF THE INVENTION

The instant invention relates to folding of a collation of paper sheets, and more particularly to the folding of a collation having more sheets than the folding apparatus can fold together simultaneously.

There is a need in the area of folding of paper sheets by means of buckle chute folders to be able to fold together a relatively large number, such as 20, 30 or more, of paper sheets or documents. This requirement comes about by virtue of businesses, such as utilities or banks or retail stores, having large statements or bills which in many cases may exceed 20 or more sheets of paper, most or all of which may need to be folded in order to be inserted into an envelope for mailing to a customer. Typically, the feeding of the sheets of paper, the folding of the sheets of paper, and the insertion of the folded sheets of paper into the envelope are effected by an inserting system comprising document feeders, accumulators, buckle chute folders and envelope feeders and inserters.

A critical limitation with the aforesaid state of the art inserting system is the inability to fold a large number of sheets together simultaneously. Some of the most critical limitations are the noise of the sheets of paper entering and leaving the folding rollers and the tremendous force required to maintain pressure of the folding rollers relative to each other as they separate to accept a large number of sheets together.

One solution to the foregoing problem is described in U.S. Pat. No. 4,898,570 issued Feb. 6, 1990 to the assignee of the instant invention, and is known as shingle folding. In this folding method, the sheets of a packet are folded sequentially, offset from each other by about 20% of the length of a sheet of paper, and the sheets are then nested together following the folding process. The drawback to this method is a lack of speed. Because of the shingling of the collation, the speed of the collation going through the folder is reduced by almost 50%.

It is known to divide a large collation into sub-sets, fold the sub-sets separately, and then combine the sub-sets for insertion into an envelope. However, the use of sub-sets does not take into account an address bearing However, the use of sub-sets does not take into account an address bearing sheet, which must appear, for many applications, on the top of the collation, face up. The normal process of sub-setting and folding would result in the address bearing sheet winding up in a position other then on the top of collation, face up.

Accordingly, the instant invention provides a method of sub-setting a large collation of sheets, folding the sub-sets, and re-combining the sub-sets so that the address bearing sheet winds up as the top sheet, face up. The final collation now has an address which can appear through the window of an envelope, or simply be located properly for reading by the recipient of the envelope.

SUMMARY OF THE INVENTION

The instant invention therefore provides a method of folding and accumulating a plurality of paper sheets. The method comprise: feeding a plurality of paper sheets seriatim into a first accumulator to form a first sub-set of paper sheets; feeding a plurality of paper sheets seriatim into a second accumulator to form a second sub-set of paper sheets; feeding said second sub-set of sheets through a folding device to form a folded second sub-set of sheets onto an accumulating deck; feeding the first sub-set of sheets through the folding device to form a folded first sub-set of sheets; and depositing the folded first subset of sheets on top of the second sub-set of sheets on the accumulating deck, to thereby form a final, folded collation consisting of the two folded sub-sets.

DETAILED DESCRIPTION OF THE PREFERRED EMBODIMENT

Figure 1:
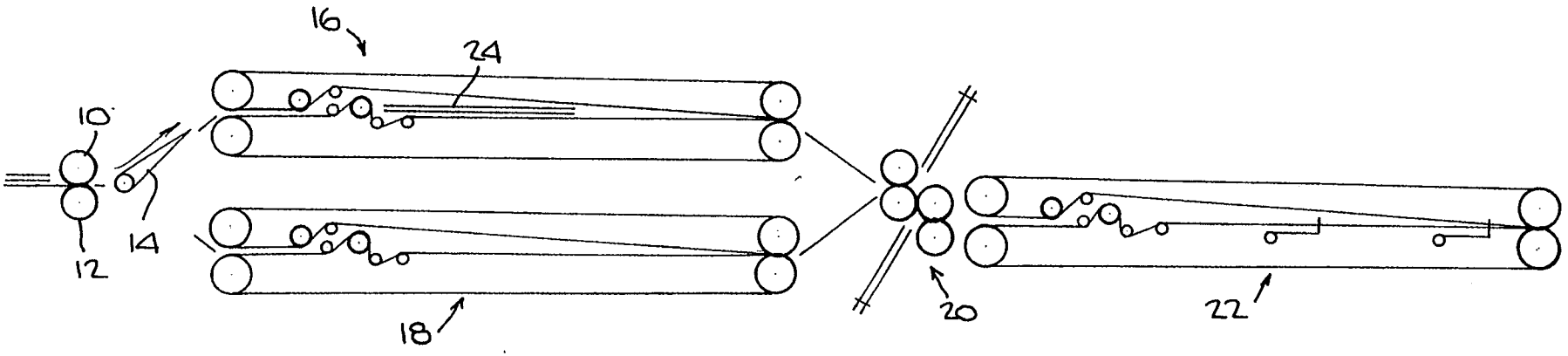
FIG. 1 is a side, elevational view of dual accumulators, a folder and an accumulation deck in accordance with the instant invention, showing a first subset collation in the top, dual accumulator.

In describing the preferred embodiment of the instant invention, reference is made to the drawings, wherein there is seen a pair of feed rollers 10 and 12 for feeding documents sedatim from paper handling apparatus (not shown) upstream. Downstream of the rollers 10 and 12 is a pivotable paper guide 14 for guiding documents into a top accumulator 16 or a bottom accumulator 18 of a dual accumulator device. Downstream of the dual accumulators 16 and 18 is a buckle chute folding device 20 whose function is well known in the art and thus requires no further discussion. Downstream of the buckle chute folder 20 is a third accumulator 22 for receiving sub-sets of documents from the folder 20, as will be explained in further detail hereinbelow. The accumulators 16, 18 and 22 are conventional and also require no further explanation.

Figure 2:
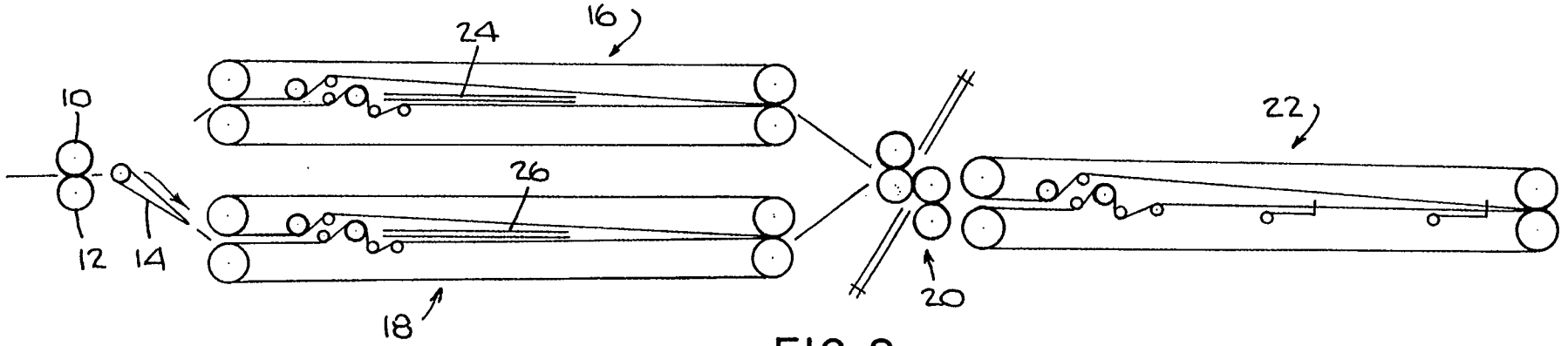
FIG. 2 is similar to FIG. 1 but shows a second sub-set accumulation in the bottom, dual accumulator.

The functioning of the foregoing apparatus will now be described. To begin with, use of the dual accumulators 16 and 18 with the folder 20 is occasioned by the need to fold a large number of sheets, a quantity large enough that cannot be folded competently by the folder 20 together as one set. Thus, a set of documents which is to be inserted ultimately into an envelope (not shown) located downstream of the accumulator 22 is fed seriatim by the rollers 12 and 14 toward the dual accumulators 16 and 18. The set is divided into two sub-sets, so that the first sub-set 24 is fed into the top accumulator 16, as seen in FIG. 1. Then, the paper guide 14 is pivoted to the position seen in FIG. 2 so that the second sub-set 26 is fed into the bottom accumulator 18, as seen in FIG. 2.

Figure 3:
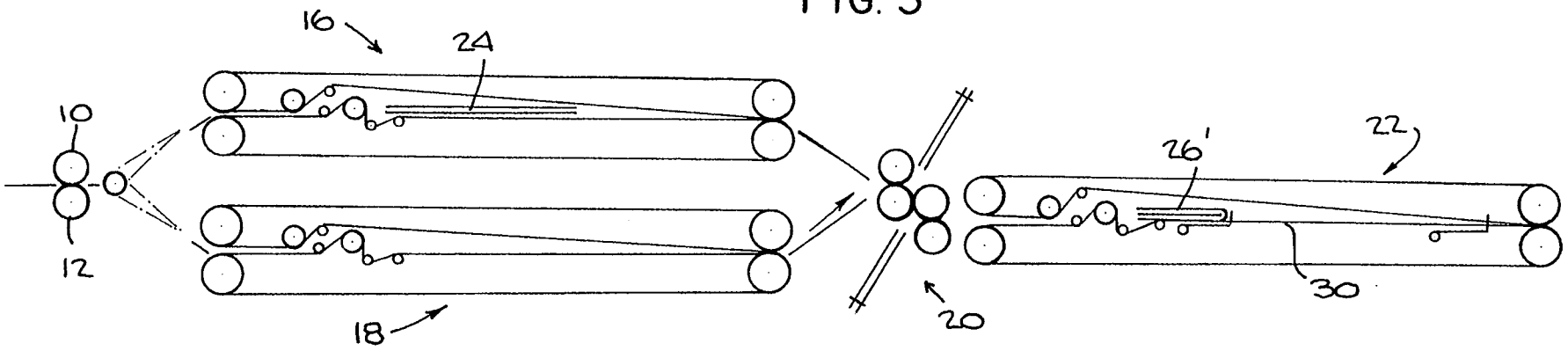
FIG. 3 is similar to FIG. 2 but shows the second sub-set accumulation having been folded and sitting in the accumulation deck.

The next step in the process of collating folded sub-sets is the feeding of the second sub-set 26 through the buckle chute folder 20. The folded sub-set 26' is then fed onto the deck 30 of the third accumulator 22, as seen in FIG. 3.

Figure 4:
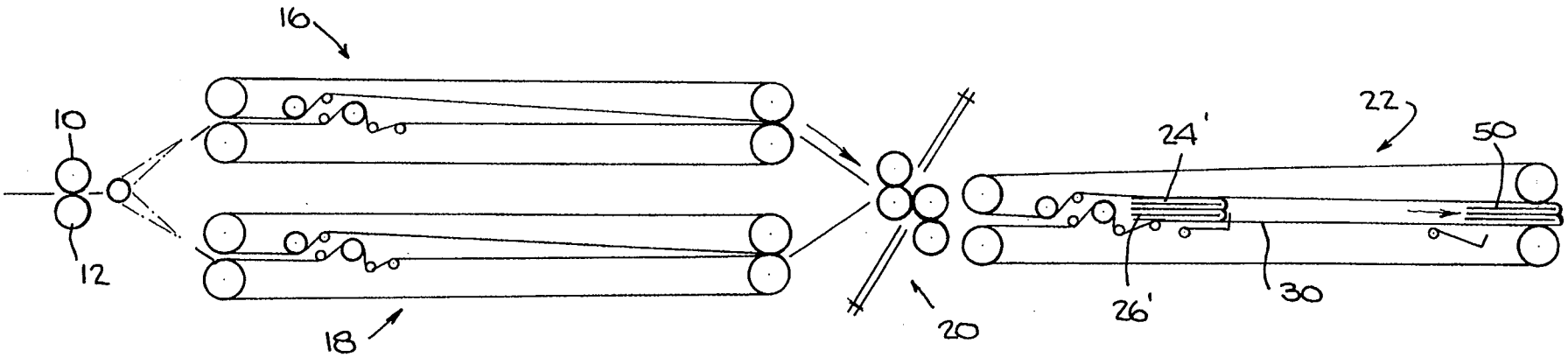
FIG. 4 is similar to FIG. 3 but shows the first sub-set accumulation sitting on top of the second sub-set accumulation on the accumulation deck.

The name/address sheet is the last sheet of the first sub-set 24, which is the top-most sheet in the top accumulator 24. The final step in the process of collating folded sub-sets is feeding the first sub-set 24 containing the name/address sheet through the buckle chute folder 20 and then depositing the folded subset 24' on top of the second folded sub-set 26' already sitting on the deck 30, as seen in FIG. 4.

Figure 5:
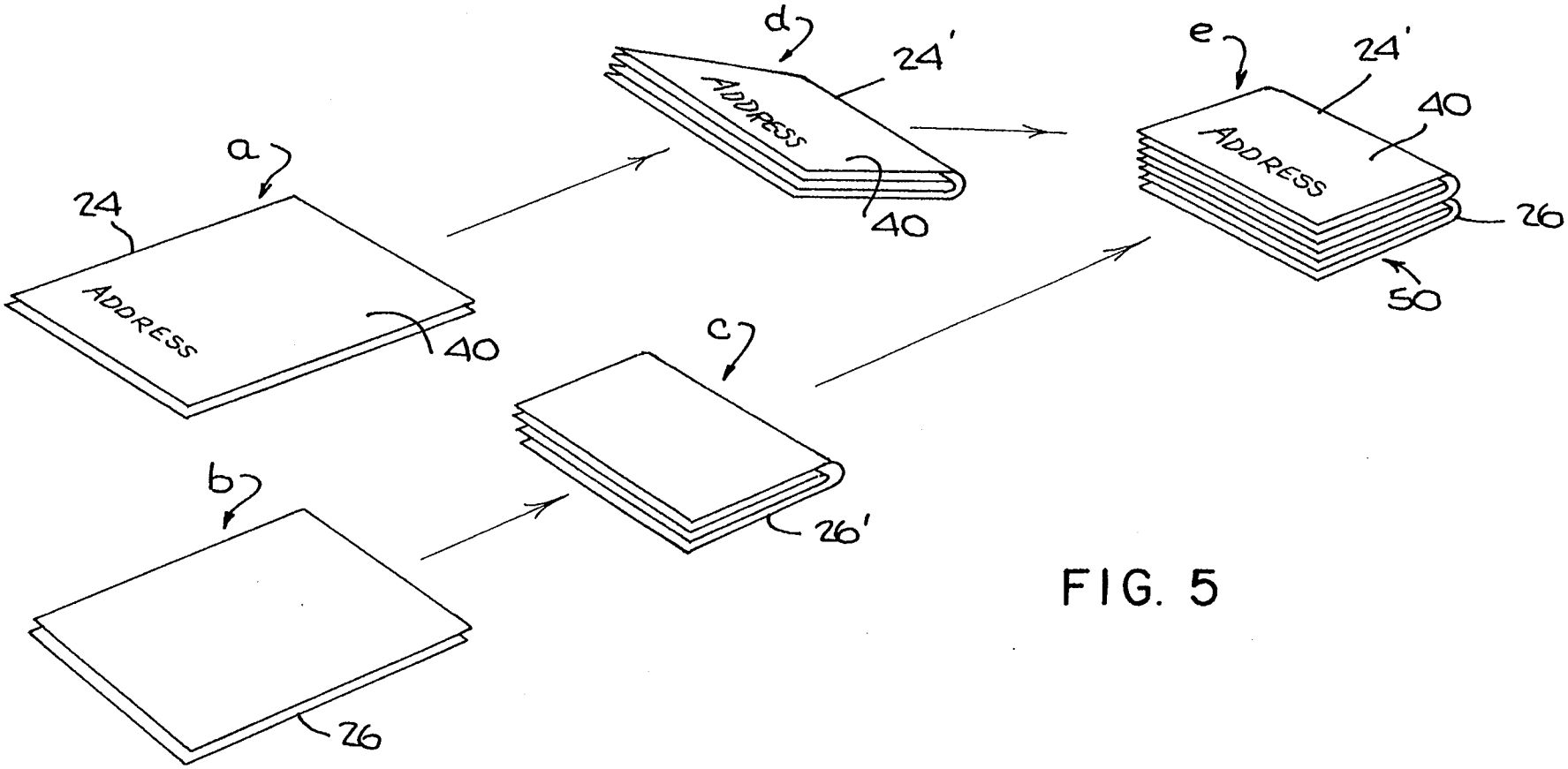
FIG. 5 is a schematic representation of the process of accumulating, folding and final accumulating of the two sub-sets seen in FIGS. 1–4.

Reference is now made to FIG. 5 in order to set forth how the sheets in each of the sub-sets 24 and 26 are fed, accumulated, folded, and reaccumulated. The first sub-set 24 includes the name/address sheet 40 which includes the name and address of the recipient of the sub-sets 24 and 26 in its lower haft portion. The letters a, b, c, d and e in FIG. 5 represent the order of the processing steps discussed hereinabove and will be discussed now in greater detail. Step a represents the first step, which is the depositing of sub-set 24 which is the first sub-set to be deposited onto an accumulator, in this case the dual accumulator 16, as seen in FIG. 1. The top sheet 40 is the name/address sheet, and contains the name and address of the recipient of the sub-sets 24 and 26 in its lower half. The top sheet 40 in reality is the last sheet to be deposited onto the dual accumulator 16 since each succeeding sheet is deposited on top of its preceding sheet.

Step b represents the next step which is the depositing of the second sub-set 26 onto the dual accumulator 18, as seen in FIG. 2. The completion of step a corresponds with the status shown in FIG. 1, and the completion of step b corresponds to the status shown in FIG. 2.

Step c represents the third step which corresponds to FIG. 3 which is the feeding of the second sub-set 26 out of the dual accumulator 18 and through the folder 20 so that a folded sub-set 26' is formed and deposited on the accumulator deck 30.

Step d represents the fourth step which corresponds to FIG. 4 which is the feeding of the first sub-set 24 out of the dual accumulator 16 and through the folder 20 so that a folded sub-set 24' is formed and deposited on top of the folded sub-set 26' sitting on the accumulator deck 30. Reference letter e in FIG. 5 represents the final collation 50 which consists of the first sub-set 24' on top of the second sub-set 26'.

Although the foregoing description illustrated an example in which the name/address sheet 40 was the last sheet to be deposited on the dual accumulator 16, it is possible to have a sub-set 24 in which the first sheet to enter the dual accumulator 16 is the name/address sheet 40, so that the name/address sheet 40 is on the bottom of the sub-set 24. In such a case, the sub-set 24 would have to be processed so that the name/address portion of the name/address sheet 40 finally appeared as the top sheet of the folded sub-set 24'. Since the name/address sheet 40 is folded around the other sheets in the sub-set 24, there are a variety of ways of processing the name/address sheet 40 so that the name/address winds up on top of the sub-set 24'. It is possible to have the sheets in the sub-sets 24 and 26 deposited upside down on the accumulators 16 and 18 and to ultimately have the name/address portion of the name/address sheet 40 wind up as the top or bottom of the final accumulation 50.

The foregoing description relates to folding of the sub-sets 24 and 26 in half. It is clearly possible to employ other types of folding, such as z folding which results in the sub-sets 24 and 26 being folded into thirds. It should also be understood that the name/address sheet 40 can be located anywhere as long as its location is known, and that the sub-sets can be arranged in any desired fashion as long as the name/address portion of the name/address sheet winds up on the outside of the ultimate collation so it can be seen through the window of an envelope or simply be the first page of the ultimate collation.

The number of sheets in each of the sub-sets 24 and 26 can vary, but preferably the sub-sets 24 and 26 should contain roughly the same number of sheets. Of course it is possible to have the first sub-set 24 include the maximum number of sheets which can be handled by the folder 20, with the remaining sheets included in the second sub-set 26.

Once the final collation 50 is assembled on the accumulator deck 30, it is ready for further processing, which includes feeding the collation 50 downstream toward an inserting machine (not shown) which will insert the collation 50 into a waiting envelope (not shown).

It should be understood by those skilled in the art that various modifications may be made in the present invention without departing from the spirit and scope thereof, as described in the specification and defined in the appended claims.

What is claimed is:

1. A method of folding and accumulating a plurality of paper sheets, comprising:

feeding a plurality of paper sheets seriatim into a first accumulator to form a first sub-set of paper sheets;

feeding a plurality of paper sheets seriatim into a second accumulator to form a second sub-set of paper sheets;

feeding said second sub-set of sheets through a folding device to form a folded second sub-set of sheets;

depositing said folded first sub-set of sheets onto an accumulating deck;

feeding said first sub-set of sheets through said folding device to form a folded first sub-set of sheets; and depositing said folded first sub-set of sheets on top of said second sub-set of sheets on said accumulating deck, to thereby form a final, folded collation consisting of said two folded sub-sets.

2. The method of claim 1 wherein said first accumulator is located above said second accumulator.

3. The method of claim 1 wherein said folding device comprises a buckle chute folder.

4. The method of claim 1 wherein the first sub-set includes a sheet containing a name and an address.

5. The method of claim 4, wherein the name and address bearing sheet is the top sheet of the first sub-set.

6. The method of claim 2, wherein said folding device comprises a buckle chute folder.

7. The method of claim 6, wherein the first sub-set includes a sheet containing a name and an address.

8. The method of claim 7, wherein the name and address bearing sheet is the top sheet of the first sub-set.

* * * * *